US009985418B1

(12) United States Patent
Kanemaru

(10) Patent No.: US 9,985,418 B1
(45) Date of Patent: May 29, 2018

(54) SPARK PLUG

(71) Applicant: NGK SPARK PLUG CO., LTD., Nagoya, Aichi (JP)

(72) Inventor: Tomonori Kanemaru, Kasugai (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days. days.

(21) Appl. No.: 15/820,522

(22) Filed: Nov. 22, 2017

(30) Foreign Application Priority Data

Nov. 29, 2016 (JP) ..... 2016-230790
May 18, 2017 (JP) ..... 2017-098796

(51) Int. Cl.
*H01T 13/08* (2006.01)
*H01T 13/20* (2006.01)

(52) U.S. Cl.
CPC ..... *H01T 13/20* (2013.01); *H01T 13/08* (2013.01)

(58) Field of Classification Search
CPC ..... H01T 13/08; H01T 13/20; H01T 13/38; H01T 13/40
See application file for complete search history.

(56) References Cited

U.S. PATENT DOCUMENTS 2,921,109 A * 1/1960 Novak ..... H01T 13/08 123/169 R
8,970,097 B2 * 3/2015 Yamada ..... H01T 13/08 313/118
9,422,911 B2 * 8/2016 Kawashima ..... F02P 15/00
2006/0284535 A1 * 12/2006 Ozeki ..... G01L 23/22 313/143

FOREIGN PATENT DOCUMENTS

JP 2013-149623 A 8/2013

* cited by examiner

*Primary Examiner* — Anne Hines
(74) *Attorney, Agent, or Firm* — Stites & Harbison, PLLC; Jeffrey A. Haeberlin; James R. Hayne

(57) ABSTRACT

A cylindrical metal shell extending in an axis direction has a seat portion projecting radially outward, and an annular gasket is disposed so as to oppose a front end surface of the seat portion. A value G/S obtained by dividing an arithmetic average roughness G of a first surface, of the gasket, which comes into contact with the front end surface of the seat portion by an arithmetic average roughness S of the front end surface of the seat portion satisfies $0.5 \leq G/S \leq 2.0$. The arithmetic average roughness G is not more than 0.16 μm, and an average of an area of a second surface on a back side of the first surface and an area of the first surface is not more than 280 $mm^2$.

3 Claims, 2 Drawing Sheets

SPARK PLUG

CROSS REFERENCE TO RELATED APPLICATION

The present application claims priority to Japanese Patent Application Nos. P2016-230790 and P2017-098796, which were filed on Nov. 29, 2016 and May 18, 2017, respectively, the disclosures of which are herein incorporated by reference in their entirety.

BACKGROUND OF THE INVENTION

Field of the Invention

The present invention relates to a spark plug and particularly relates to a spark plug that allows improvement of thermal resistance.

Description of Related Art

A spark plug is mounted to an engine by a screw portion of a metal shell holding an insulator being joined into a screw hole of the engine. In order to prevent leakage of combustion gas from the screw hole, a gasket is disposed between the engine and a seat portion, of the metal shell, which projects radially outward (see, for example, Patent Document 1).

RELATED ART DOCUMENT

Patent Document 1 is Japanese Patent Application Laid-Open (kokai) No. 2013-149623.

BRIEF SUMMARY OF THE INVENTION

However, in the above-described conventional technique, there is a need for improving thermal resistance.

The present invention has been conceived to meet the above-described need, and an object of the invention is to provide a spark plug that allows improvement of heat transfer property and improvement of thermal resistance.

In order to attain the above object, in a spark plug according to the present invention, a cylindrical metal shell extending in an axis direction has a seat portion projecting radially outward, and an annular gasket is disposed so as to oppose a front end surface of the seat portion. A value G/S obtained by dividing an arithmetic average roughness G of a first surface, of the gasket, which comes into contact with the front end surface of the seat portion by an arithmetic average roughness S of the front end surface of the seat portion satisfies $0.5 \leq G/S \leq 2.0$. The arithmetic average roughness G is not more than 0.16 μm. An average of an area of a second surface on a back side of the first surface and an area of the first surface is not more than 280 $mm^2$. In other words, a spark plug is provided including a cylindrical metal shell extending in an axis direction and including a seat portion projecting radially outward, with the seat portion having a front end surface with a first arithmetic average roughness S. The spark plug further includes an annular gasket configured to oppose the front end surface of the seat portion, the gasket having a first surface in contact with the front end surface of the seat portion and a second surface opposite the first surface, the first surface of the gasket having a second arithmetic average roughness G. The second arithmetic average roughness G of the first surface of the gasket is not more than 0.16 μm, and a value G/S is obtained by dividing the second arithmetic average roughness G of the first surface of the gasket by the first arithmetic average roughness S of the front end surface of the seat portion, such that the value G/S satisfies $0.5 \leq G/S \leq 2.0$. Also, an average of an area of the second surface of the gasket and an area of the first surface of the gasket is not more than 280 $mm^2$.

In the spark plug according to a first aspect of the present invention, since heat transfer from the seat portion to the gasket can be improved and heat can be dissipated to the engine through the gasket in which the average of the area of the first surface and the area of the second surface is not more than 280 $mm^2$, an effect of improving thermal resistance can be obtained.

In the spark plug according to a second aspect of the present invention, since the gasket is formed into a solid plate shape, a cross-sectional area, of the gasket, which contributes to thermal conduction can be ensured. Therefore, in addition to the effect of the first aspect of the present invention, an effect of improving thermal conductivity of the gasket and improving thermal resistance can be obtained.

In the spark plug according to a third aspect of the present invention, since the gasket has an outer diameter of not more than 15 mm, an effect of reducing the diameter of the spark plug and ensuring thermal resistance can be obtained in addition to the effect of the first aspect or the second aspect of the present invention.

BRIEF DESCRIPTION OF THE DRAWINGS

Illustrative aspects of the invention will be described in detail with reference to the following figures wherein.

DETAILED DESCRIPTION OF EXEMPLARY EMBODIMENTS OF THE INVENTION

Figure 1:
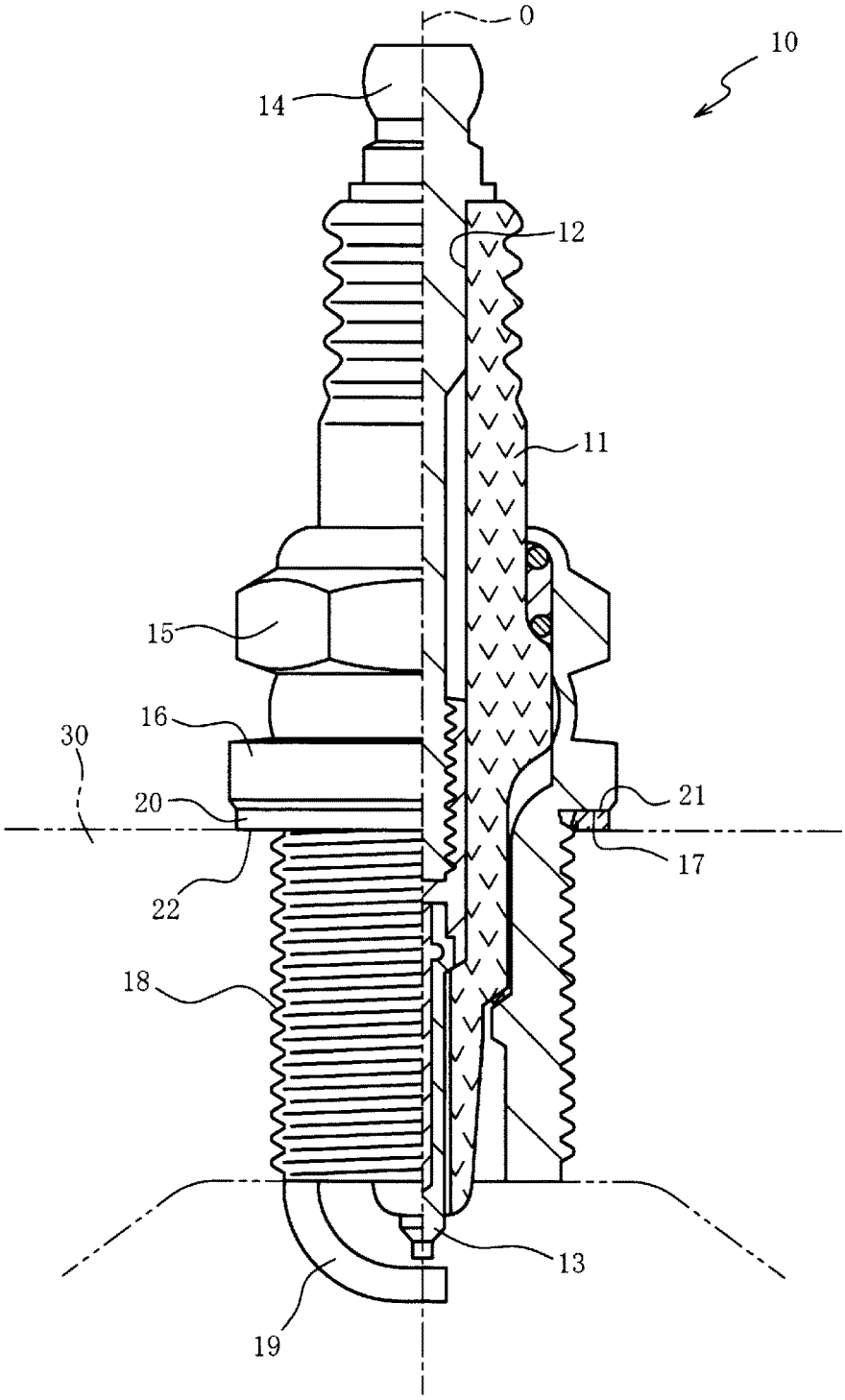
FIG. 1 is a cross-sectional view of one side of a spark plug according to an embodiment of the present invention.

Hereinafter, preferred embodiments of the present invention will be described with reference to the accompanying drawings. FIG. 1 is a cross-sectional view of one side of a spark plug 10 according to an embodiment of the present invention. In FIG. 1, the lower side on the surface of the drawing sheet is referred to as a front side of the spark plug 10, and the upper side on the surface of the drawing sheet is referred to as a rear side of the spark plug 10. The spark plug 10 includes an insulator 11 and a metal shell 15.

The insulator 11 is a member made of alumina or the like which is excellent in mechanical property and insulation property at a high temperature, and has an axial hole 12 that penetrates therethrough along an axis O. A center electrode 13 is disposed on the front side of the axial hole 12.

The center electrode 13 is a rod-shaped member which extends along the axis O and in which a core material made of copper or a core material that contains copper as a main component is covered with nickel or a nickel-based alloy. The center electrode 13 is held by the insulator 11 and has a front end that is exposed from the axial hole 12.

A metal terminal 14 is a rod-shaped member to which a high-voltage cable (not shown) is connected, and is made of a metal material (e.g., low-carbon steel or the like) having conductivity. The metal terminal 14 has a front end side portion pressed in the axial hole 12, and is fixed to a rear end portion of the insulator 11.

The metal shell 15 is crimped and fixed, around the outer circumference of the insulator 11, to the front end side portion thereof which is distant from the rear end of the insulator 11 by a predetermined distance in the axis O direction such that an insulation distance between the metal shell 15 and the metal terminal 14 is ensured. The metal shell 15 is a substantially cylindrical member made of a metal material (e.g., low-carbon steel or the like) having conductivity. The metal shell 15 includes an annular seat portion 16 that is flange-shaped and projects radially outward, and a screw portion 18 that is formed on the outer circumferential surface of the metal shell 15 in a portion forward of the seat portion 16. The metal shell 15 is fixed by the screw portion 18 being fastened into a screw hole of an engine 30 (cylinder head). A gasket 20 (described later) is disposed between a front end surface 17 of the seat portion 16 and the engine 30.

A ground electrode 19 is a metal member (e.g., made of a nickel-based alloy) that is joined to the front end of the metal shell 15. In the present embodiment, the ground electrode 19 is formed in a bar shape, and has a front end side portion that is bent to oppose the center electrode 13. A spark gap is formed between the ground electrode 19 and the center electrode 13.

The gasket 20 is an annular member and includes a first surface 21 that comes into contact with the front end surface 17 of the seat portion 16 and a second surface 22 that opposes the engine 30. The gasket 20 is held between the seat portion 16 and the engine 30, and prevents leakage of combustion gas from the screw hole of the engine 30. The gasket 20 is made of a metal and contains copper as a main component, and contains elements such as nickel, tin, and phosphorus as well as copper. However, the gasket 20 is not limited to the gasket that is made of a metal and that contains copper as a main component, and, as a matter of course, another publicly known material such as mild steel, pure iron, stainless steel, aluminum, titanium, or the like may be adopted.

Figure 2A:
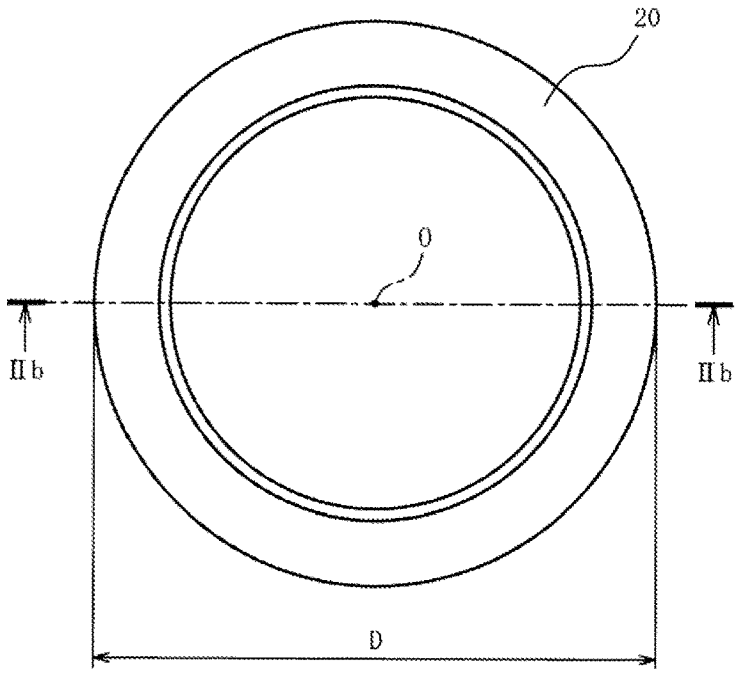
FIG. 2A is a plan view of a gasket.
Figure 2B:
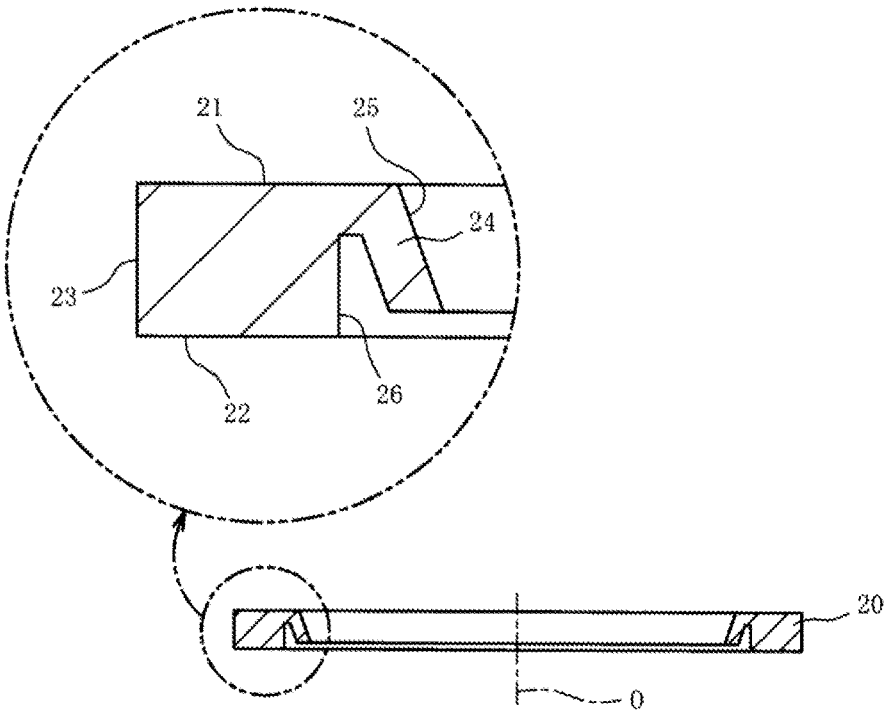
FIG. 2B is a cross-sectional view of the gasket, including an axis O, taken along the line IIb-IIb shown in FIG. 2A.

FIG. 2A is a plan view of the gasket 20, and FIG. 2B is a cross-sectional view of the gasket 20, including the axis O, taken along the line IIb-IIb shown in FIG. 2A. In the present embodiment, the gasket 20 is formed into a solid plate shape. Solid means stuffed and having no hollow portion, and specifically means that the gasket is not formed by a plate material being bent.

The gasket 20 includes the annular first surface 21, the annular second surface 22 that is disposed on the side opposite to the first surface 21 side, an outer peripheral side surface 23 that connects between the second surface 22 and the first surface 21 on the outer peripheral side of the gasket 20, a projection portion 24 that projects radially inward from a portion in the vicinity of the first surface 21, and an inner peripheral side surface 26 that connects between the projection portion 24 and the second surface 22. The projection portion 24 is engaged with a rear end portion of the screw portion 18 (see FIG. 1) to regulate movement of the gasket 20 in an axis direction with respect to the screw portion 18. An inner peripheral surface 25 of the projection portion 24 is tilted with respect to the axis O.

The first surface 21 comes into contact with the front end surface 17 of the seat portion 16 (see FIG. 1), and is adjacent to the outer peripheral side surface 23 and the inner peripheral surface 25. The second surface 22 comes into contact with the engine 30 (see FIG. 1), and is adjacent to the outer peripheral side surface 23 and the inner peripheral side surface 26.

In the gasket 20, the average, obtained by adding the area of the first surface 21 and the area of the second surface 22 and dividing the total area of the two surfaces by two, is set to be not more than 280 $mm^2$. In the present embodiment, the gasket 20 has an outer diameter D of not more than 15 mm.

In the spark plug 10, an arithmetic average roughness Ra (hereinafter referred to as "G") of the first surface 21 of the gasket 20 is set to be not more than 0.16 μm, and a value G/S, obtained by dividing the arithmetic average roughness G by an arithmetic average roughness Ra (hereinafter referred to as "S") of the front end surface 17 of the seat portion 16, satisfies $0.5 \leq G/S \leq 2.0$. It is noted that the surface roughness refers to the surface roughness, of each of the seat portion 16 and the gasket 20, obtained before the spark plug 10 is mounted to the engine 30.

The arithmetic average roughness G and the arithmetic average roughness S are each calculated on the basis of JIS B0601 (2013 edition). The arithmetic average roughness G is an average of values, of arithmetic average roughness, at eight locations at which the first surface 21 can be divided into eight equal portions in a circumferential direction. The arithmetic average roughness S is an average of values, of arithmetic average roughness, at eight locations at which the front end surface 17 can be divided into eight equal portions in a circumferential direction. The arithmetic average roughness of the first surface 21 is measured in the back side portion of the second surface 22 (portion other than the projection portion 24). This is because, since, in the projection portion 24, compressive stress is not generated by the first surface 21 and the second surface 22 being pressed, the seat portion 16 hardly contributes to thermal conduction of the gasket 20. Therefore, the surface roughness of the first surface 21 in the portion other than the projection portion 24 is measured.

When the roughness of the front end surface 17 of the seat portion 16 and the roughness of the first surface 21 of the gasket 20 satisfy $G \leq 0.16$ μm and $0.5 \leq G/S \leq 2.0$, the heat transfer from the seat portion 16 to the gasket 20 can be improved and heat can be dissipated to the engine 30 through the gasket 20. As a result, thermal resistance of the spark plug 10 can be improved.

Since the gasket 20 is formed into a solid plate shape, a cross-sectional area of the gasket 20 orthogonal to the axis O can be ensured. Since the cross-sectional area of the gasket 20 contributes to thermal conduction, thermal conductivity of the gasket 20 can be improved and thermal resistance of the spark plug 10 can be improved.

Since, in the gasket 20, the average of the area of the first surface 21 and the area of the second surface 22 is set to be not more than 280 $mm^2$, the diameter of the spark plug 10 can be reduced. In the present embodiment, the gasket 20 has the outer diameter D of not more than 15 mm. However, since, in the spark plug 10 having a small outer diameter, the cross-sectional areas of the center electrode 13 and the metal shell 15 become small, heat transfer property (so-called heat conduction) is likely to decrease. However, since, by setting as above the roughness of each of the front end surface 17 and the first surface 21, it is possible to improve the heat transfer property of the gasket 20 in which the average of the area of the first surface 21 and the area of the second surface 22 is not more than 280 $mm^2$, the diameter of the spark plug 10 can be reduced while thermal resistance of the spark plug 10 can be ensured.

The present invention will be more specifically described according to examples. However, the present invention is not limited to the examples.

The screw portion 18 of the spark plug 10 was fastened into a nut that was made of an aluminum alloy and that was supported by an arm, and the gasket 20 was held between the seat portion 16 of the spark plug 10 and the nut. A test was performed to evaluate the heat transfer property of the gasket 20 by heating, by means of a burner, the ground electrode 19 projecting from the nut and measuring a difference in temperature between the seat portion 16 and the gasket 20. Hereinafter, a test method will be described.

A. Samples Used in Test

In the spark plug 10 used in the test, the nominal diameter of the screw portion 18 was 10 mm. The gasket 20 was an annular solid plate material made of a metal that contains copper as a main component, and the dimensions were such that the outer diameter was 14.8 mm (tolerance +0.3 mm, −0 mm), the inner diameter was 9.9 mm (tolerance +0.1 mm, −0 mm), and the thickness was 1.5 mm (tolerance ±0.05 mm). The outer diameter of the seat portion 16 of the spark plug 10 was made greater than the outer diameter of the gasket 20. The dimensions of the nut into which the screw portion 18 was fastened were such that the width across flats (opposed sides of a hexagon) was 30 mm (tolerance +0 mm, −0.5 mm) and the thickness was about 10 mm. Various spark plugs 10 (samples 1 to 23) were prepared such that the size and material were the same among the samples of the spark plug 10 (including the gasket 20), and only the surface roughness of each of the seat portion 16 and the gasket 20 was different among the samples.

For comparison, the spark plugs 10 (samples 24 to 29), in each of which the nominal diameter of the screw portion 18 was 12 mm, were prepared and the spark plugs 10 (samples 30 to 33), in each of which the nominal diameter of the screw portion 18 was 14 mm, were prepared. The gaskets 20 in samples 24 to 33 were each formed also into an annular solid plate material made of a metal that contains copper as a main component. In each of the samples 1 to 33, the average, obtained by adding the area of the first surface 21 of the gasket 20 and the area of the second surface 22 of the gasket 20 and dividing the total area of the two surfaces by two, was obtained.

B. Measurement of Surface Roughness

Before the gasket 20 was mounted to the metal shell 15, the arithmetic average roughness Ra of the front end surface 17 of the seat portion 16, the arithmetic average roughness Ra of the first surface 21 of the gasket 20, and the arithmetic average roughness Ra of the second surface 22 of the gasket 20 were measured by means of a contact-type surface roughness measuring machine on the basis of JIS B0601 (2013 edition). The arithmetic average roughness is an average of values, of arithmetic average roughness, at eight locations at which each of the front end surface 17, the first surface 21, and the second surface 22 can be divided into eight equal portions in a circumferential direction. By removing a long-wavelength component (waviness component) through a high-pass filter with a cutoff value λc of 80 μm, a roughness component of each measurement location was measured. The measurement length at one measurement location was about 800 μm.

C. Test

After the gasket 20 was mounted to the metal shell 15, the screw portion 18 of the spark plug 10 was screwed into the nut supported by the arm with a torque of 15 N.m, and the spark plug 10 was mounted in a state where the gasket 20 was held between the seat portion 16 and the nut. The front end of the ground electrode 19 was heated in flame of a burner, such that the temperature of the ground electrode 19 in the spark plug 10 became 900° C., and the temperature of the center of a side surface of the seat portion 16 and the temperature of the center of the outer peripheral side surface 23 of the gasket 20 were measured by means of a thermocouple after elapse of five minutes from the start of the heating.

In this test, the heat transferred from the seat portion 16 to the gasket 20 was transferred from the nut to the arm. Therefore, it is possible to say that, when the difference in temperature between the seat portion 16 and the gasket 20 is smaller, the heat transfer property of the gasket 20 is better. Accordingly, a sample in which the difference in temperature between the center of the side surface of the seat portion 16 and the center of the outer peripheral side surface 23 of the gasket 20 was not more than 2° C. was evaluated as "excellent".

Table 1 indicates the average of the area of the first surface 21 and the area of the second surface 22, the arithmetic average roughness of the front end surface 17 of the seat portion 16, the arithmetic average roughness of the first surface 21 of the gasket 20, and the arithmetic average roughness of the second surface 22 of the gasket 20, the temperature of the center of the side surface of the seat portion 16, the temperature of the center of the outer peripheral side surface 23 of the gasket 20, the difference in temperature between the two centers, and evaluations.

TABLE 1

| No | Average of areas of first surface and second surface ($mm^2$) | Arithmetic average roughness: Gasket: Second surface (μm) | Arithmetic average roughness: Gasket: First surface (G) (μm) | Arithmetic average roughness: Front end surface of seat portion (S) (μm) | G/S (—) | Temperature: Seat portion (° C.) | Temperature: Gasket (° C.) | Temperature: Difference (° C.) | Evaluation |
|---|---|---|---|---|---|---|---|---|---|
| 1 | 280 | 0.18 | 0.09 | 0.08 | 1.13 | 293 | 292 | 1 | Excellent |
| 2 | 280 | 0.18 | 0.14 | 0.08 | 1.75 | 293 | 292 | 1 | Excellent |
| 3 | 280 | 0.18 | 0.16 | 0.08 | 2.00 | 293 | 291 | 2 | Excellent |
| 4 | 280 | 0.18 | 0.09 | 0.12 | 0.75 | 293 | 292 | 1 | Excellent |
| 5 | 280 | 0.18 | 0.08 | 0.16 | 0.50 | 293 | 291 | 2 | Excellent |
| 6 | 280 | 0.25 | 0.09 | 0.08 | 1.13 | 305 | 304 | 1 | Excellent |
| 7 | 280 | 0.25 | 0.09 | 0.12 | 0.75 | 306 | 305 | 1 | Excellent |
| 8 | 280 | 0.25 | 0.14 | 0.08 | 1.75 | 307 | 305 | 2 | Excellent |
| 9 | 280 | 0.25 | 0.16 | 0.08 | 2.00 | 306 | 304 | 2 | Excellent |
| 10 | 280 | 0.25 | 0.08 | 0.16 | 0.50 | 305 | 303 | 2 | Excellent |
| 11 | 280 | 0.30 | 0.09 | 0.08 | 1.13 | 309 | 308 | 1 | Excellent |
| 12 | 280 | 0.30 | 0.16 | 0.08 | 2.00 | 309 | 308 | 1 | Excellent |
| 13 | 280 | 0.18 | 0.20 | 0.40 | 0.50 | 295 | 290 | 5 | Good |
| 14 | 280 | 0.18 | 0.20 | 0.08 | 2.50 | 295 | 290 | 5 | Good |

TABLE 1-continued

| No | Average of areas of first surface and second surface ($mm^2$) | Arithmetic average roughness: Gasket: Second surface (μm) | Arithmetic average roughness: Gasket: First surface (G) (μm) | Arithmetic average roughness: Front end surface of seat portion (S) (μm) | G/S (—) | Temperature: Seat portion (° C.) | Temperature: Gasket (° C.) | Temperature: Difference (° C.) | Evaluation |
|---|---|---|---|---|---|---|---|---|---|
| 15 | 280 | 0.18 | 1.00 | 0.08 | 12.50 | 298 | 291 | 7 | Good |
| 16 | 280 | 0.18 | 0.09 | 0.48 | 0.19 | 299 | 291 | 8 | Good |
| 17 | 280 | 0.25 | 0.20 | 0.08 | 2.50 | 308 | 305 | 3 | Good |
| 18 | 280 | 0.25 | 0.09 | 0.30 | 0.30 | 308 | 303 | 5 | Good |
| 19 | 280 | 0.25 | 0.16 | 0.48 | 0.33 | 309 | 302 | 7 | Good |
| 20 | 280 | 0.25 | 1.00 | 0.08 | 12.50 | 309 | 302 | 7 | Good |
| 21 | 280 | 0.30 | 0.20 | 0.08 | 2.50 | 313 | 309 | 4 | Good |
| 22 | 280 | 0.30 | 0.09 | 0.30 | 0.30 | 314 | 310 | 4 | Good |
| 23 | 280 | 0.30 | 0.09 | 0.48 | 0.19 | 316 | 309 | 7 | Good |
| 24 | 380 | 0.18 | 0.09 | 0.08 | 1.13 | 162 | 160 | 2 | Excellent |
| 25 | 380 | 0.25 | 0.09 | 0.08 | 1.13 | 163 | 162 | 1 | Excellent |
| 26 | 380 | 0.30 | 0.09 | 0.08 | 1.13 | 162 | 161 | 1 | Excellent |
| 27 | 380 | 0.18 | 0.20 | 0.40 | 0.50 | 163 | 162 | 1 | Excellent |
| 28 | 380 | 0.25 | 0.20 | 0.08 | 2.50 | 163 | 161 | 2 | Excellent |
| 29 | 380 | 0.30 | 0.20 | 0.08 | 2.50 | 164 | 163 | 1 | Excellent |
| 30 | 495 | 0.18 | 0.09 | 0.08 | 1.13 | 132 | 130 | 2 | Excellent |
| 31 | 495 | 0.25 | 0.09 | 0.08 | 1.13 | 133 | 132 | 1 | Excellent |
| 32 | 495 | 0.18 | 0.20 | 0.40 | 0.50 | 133 | 131 | 2 | Excellent |
| 33 | 495 | 0.25 | 0.20 | 0.08 | 2.50 | 132 | 131 | 1 | Excellent |

According to Table 1, it has been confirmed that, in samples 1 to 12 in which the arithmetic average roughness (G) of the first surface 21 of the gasket 20 that came into contact with the seat portion 16 was not more than 0.16 μm and the value G/S, obtained by dividing the arithmetic average roughness (G) of the first surface 21 by the arithmetic average roughness (S) of the front end surface 17 of the seat portion 16, satisfied $0.5 \leq G/S \leq 2.0$, the difference in temperature between the seat portion 16 and the gasket 20 was able to be made not more than 2° C., regardless of the arithmetic average roughness of the second surface 22 of the gasket 20 that came into contact with the engine 30.

Meanwhile, in samples 16, 18, 19, 22, and 23, although the arithmetic average roughness (G) of the first surface 21 was not more than 0.16 μm, the difference in temperature between the seat portion 16 and the gasket 20 was not able to be made not more than 2° C. In samples 16, 18, 19, 22, and 23, $G/S<0.5$ was satisfied and $0.5 \leq G/S \leq 2.0$ was not satisfied. Therefore, it has been found that the heat transfer from the seat portion 16 to the gasket 20 depends on a relation (G/S) between the arithmetic average roughness (G) of the first surface 21 of the gasket 20 and the arithmetic average roughness (S) of the front end surface 17 of the seat portion 16.

In addition, it was found that, in samples 27 to 29, 32, and 33, although the arithmetic average roughness (G) of the first surface 21 was 0.2 μm and G was greater than 0.16 μm, the difference in temperature between the seat portion 16 and the gasket 20 was able to be made not more than 2° C. It is assumed that, since, in samples 27 to 29, 32, and 33, the average of the area of the first surface 21 and the area of the second surface 22 was 380 $mm^2$ or 495 $mm^2$ that was greater than 280 $mm^2$, the heat transfer from the seat portion 16 to the gasket 20 was able to be ensured without controlling the surface roughness of each of the gasket 20 and the front end surface 17.

According to these examples, it has been confirmed that, in a case where the arithmetic average roughness (G) of the first surface 21 of the gasket 20 is not more than 0.16 μm and the value G/S, obtained by dividing the arithmetic average roughness (G) of the first surface 21 by the arithmetic average roughness (S) of the front end surface 17 of the seat portion 16, satisfies $0.5 \leq G/S \leq 2.0$, the heat transfer from the seat portion 16 to the gasket 20 is able to be improved although, in the gasket 20, the average of the area of the first surface 21 and the area of the second surface 22 is not more than 280 $mm^2$. It is assumed that, in each of samples 1 to 12, compatibility between the first surface 21 of the gasket 20 and the front end surface 17 of the seat portion 16 was able to be better and heat transfer property was able to be improved. It is clear that, when the heat transfer from the seat portion 16 to the gasket 20 is improved, heat in the metal shell 15 and the insulator 11 can be sufficiently dissipated to the engine 30 through the gasket 20 and thus it is possible to improve thermal resistance of the spark plug 10, having a small diameter, to which a gasket having a small surface area is mounted.

As described above, although the present invention has been described based on the embodiments, the present invention is not limited to the above-described embodiments at all. It can be easily understood that various modifications can be devised without departing from the gist of the present invention. For example, the shape, dimensions, and the like of the gasket 20 are not limited to the above-described ones and can be set as appropriate.

Although, in the above embodiment, a case where the gasket 20 is formed into a solid plate material has been described, the present invention is not necessarily limited thereto. As a matter of course, a gasket in which a plate material is bent to provide a hollow portion thereinside such that elasticity of the gasket is increased, may be adopted. This is because, since compatibility between the gasket and the seat portion 16 can be made good by setting the surface roughness of the seat portion 16 side surface of the gasket and the surface roughness of the front end surface 17 of the seat portion 16, the heat transfer between the seat portion and the gasket can be improved.

Although, in the above embodiment, the spark plug 10 in which the ground electrode 19 opposes the front end of the center electrode 13 has been described, the structure of a spark plug is not limited thereto. As a matter of course, the technique of the present embodiment may be applied to another type of spark plug including the gasket 20. Examples of the other type of spark plug include, for example, a spark plug in which the ground electrode 19 opposes the side surface of the center electrode 13, a multi-ground electrodes type spark plug in which the plurality of the ground electrodes 19 are joined to the metal shell 15, a spark plug in which an annular ground electrode is provided at the front end of the metal shell that projects in the axis direction as compared with the center electrode, a spark plug in which the ground electrode 19 is omitted and the center electrode is covered with a cylindrical insulator having a bottom, and the like.

DESCRIPTION OF REFERENCE NUMERALS

10: spark plug
15: metal shell
16: seat portion
17: front end surface
20: gasket
21: first surface
22: second surface
O: axis

What is claimed is:

1. A spark plug comprising:

a cylindrical metal shell extending in an axis direction and including a seat portion projecting radially outward, the seat portion having a front end surface with a first arithmetic average roughness S; and an annular gasket configured to oppose the front end surface of the seat portion, the gasket having a first surface in contact with the front end surface of the seat portion and a second surface opposite the first surface, the first surface of the gasket having a second arithmetic average roughness G, wherein a value G/S satisfies $0.5 \leq G/S \leq 2.0$;

the second arithmetic average roughness G is not more than 0.16 μm; and an average of an area of the second surface of the annular gasket and an area of the first surface of the annular gasket is not more than 280 $mm^2$.

2. A spark plug according to claim 1, wherein the gasket is formed into a solid plate shape.

3. A spark plug according to claim 1, wherein the gasket has an outer diameter of not more than 15 mm.

* * * * *